United States Patent [19]

Fulgoni

[11] 4,258,733

[45] Mar. 31, 1981

[54] METHOD FOR PERMANENT WAVING AND MEANS FOR PRACTICING THIS METHOD

[76] Inventor: Jean-Claude Fulgoni, 36, Avenue de la Gare, 91470 Limours, France

[21] Appl. No.: 60,183

[22] Filed: Jul. 24, 1979

[30] Foreign Application Priority Data

Jul. 25, 1978 [FR] France ..... 78 22017

[51] Int. Cl.[3] ..... A45D 6/00; A45D 6/18

[52] U.S. Cl. ..... 132/43 A; 132/36.2 R

[58] Field of Search ..... 132/43 A, 36.2 B, 36.2 R, 132/7, 79 R, 79 F

[56] References Cited

U.S. PATENT DOCUMENTS

| | | | |
|---|---|---|---|
| 1,735,183 | 11/1929 | Salerno | 132/79 F |
| 2,092,578 | 9/1937 | Interrante | 132/43 A |
| 2,166,386 | 7/1939 | Auster | 132/43 A |
| 2,349,285 | 5/1944 | Korf et al. | 132/36.2 R |
| 2,794,440 | 6/1957 | Levie | 132/7 |
| 3,367,345 | 2/1968 | Riley | 132/36.2 R |
| 3,465,759 | 9/1969 | Haefele | 132/36.2 R |
| 3,548,842 | 12/1970 | McCall | 132/36.2 R |

*Primary Examiner*—Paul J. Hirsch

*Attorney, Agent, or Firm*—Larson, Taylor and Hinds

[57] ABSTRACT

An improved method for the permanent waving of hair only in the vicinity of its root by enveloping the portion of the hair not to be treated with a flexible and impermeable protective sheet in a fluid-tight manner so as to shield it from action of the permanent wave product.

17 Claims, 4 Drawing Figures

METHOD FOR PERMANENT WAVING AND MEANS FOR PRACTICING THIS METHOD

Figure 1:
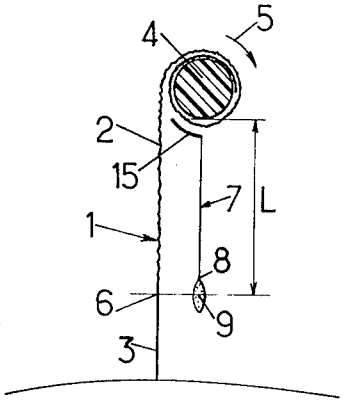

The present invention relates to improvements in or to methods for carrying out a permanent wave on a hair only in the vicinity of the root of the latter.

The treatment by permanent waving of only the portion of a hair which is in the vicinity of the root of the latter enables a swelling appearance to be given to a hairdo in which the portion of the hairs not close to the roots remain straight. By "straight", must be understood a hair or a portion of a hair not subject to the effect of the permanent wave and hence not having an artificial wave, but which can however, of course, have its own natural wave.

The invention is directed also to the treatment by permanent waving of a hair which has already previously undergone such an operation and which presents, in the vicinity of its root, a grown out straight portion. In this case, up to the present, the whole length of the hair is subject to successive permanents. Now, experience shows that the application repeated, at relatively close intervals of the order of 3 to 4 months, of a permanent waving product to a hair renders the latter fragile and brittle.

Due to this fact, it is inadvisable to renew this operation too frequently, which prevents the persons concerned from always having an impeccable hairdo.

It is an essential object of the invention to avoid these drawbacks presented by the processes of treatment employed hitherto, and of ensuring notably, in the case of hair which has already been subjected previously to a permanent, that this hair is not rendered fragile and brittle.

According to a first aspect, the invention provides a method for subjecting to a permanent wave only the portion of a hair in the vicinity of its root, which method consists of shielding from the action of the permanent wave product the portion of the hair not situated in the vicinity of the root. In the case of a hair having already been subjected previously to a permanent wave and having a portion which has grown straight in the vicinity of the root, the portion of the hair which has already been subjected to the preceding permanent wave is shielded from the action of the permanent wave product. In a way, only the portion which has regrown since the previous operation and which does not have a wave is subjected to the permanent, whilst the portion of the hair which has already been subjected to a prior treatment is not exposed to a fresh application of the permanent wave product and hence cannot become brittle.

Preferably, the portion of the hair to be shielded from the action of the permanent wave product is enveloped by means of a protective sheet of an impermeable material.

For this purpose, the impermeable sheet is arranged along the stretched hair, in line with the portion of the latter to be shielded from the action of the permanent wave product, and the assembly is rolled, from the tip of the hair, on a hair curler, said sheet being situated on the same side of the hair as the hair curler, only the portion of the hair to be treated remaining finally accessible to the action of the permanent wave product.

According to a second aspect, the invention provides a protective sheet, for the application of the preceding method, which is characterized in that it is flexible and constituted of an impermeable material and in that one of its edges is rigidified and has an incurved shape whose complexity is, in the position of placing it on the hair curler, turned towards the hair.

It is advantageous to arrange that the edge opposite the aforesaid edge and intended to be arranged in line with the separation zone between the portion of the hair to be protected and the portion to be treated, should be provided with arresting means to prevent, in the course of the treatment, the permanent wave product from running along the hair and reaching the portion to be protected, the length of this sheet being at least equal to the perimeter of a hair curler on which the hair is wound.

Due to the presence of these arresting means, the permanent wave product cannot flow, notably by capillarity, along the hairs or the sheet and is prevented from reaching the previously waved portion of the hair.

Preferably, these arresting means comprise a strip or beading of absorbent material, for example a synthetic foam, such as polyurethane foam.

Lastly, according to a third aspect, the invention provides a packaging for the utilization of the above method and comprising the container for the permanent wave product and a batch of protective sheets such as defined above.

Figure 2:
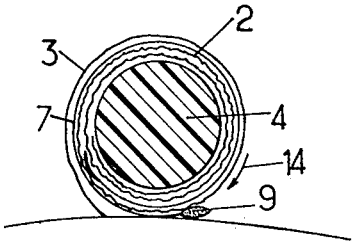
Figure 3:
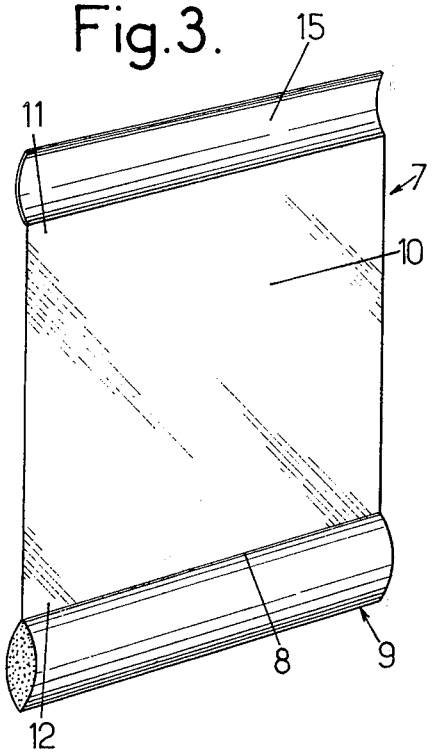
Figure 4:
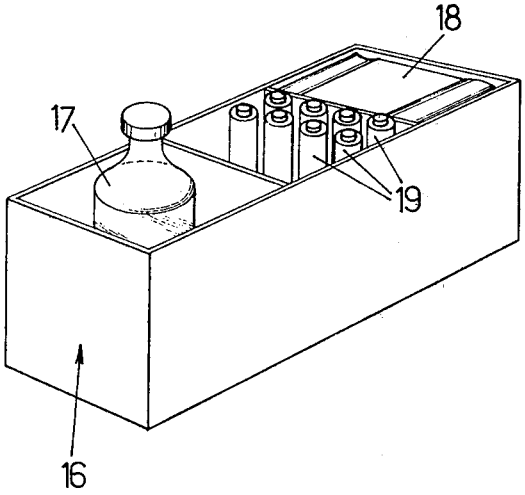

The invention will be better understood by means of the description which follows, in which reference is made to the accompanying drawing in which:

FIGS. 1 and 2 illustrate respectively two steps of the method according to the invention, FIG. 3 shows, in perspective view, an embodiment of a protective sheet in accordance with the invention, and FIG. 4 shows, in perspective view, an embodiment of a packaged unit for the application of the method according to the invention.

Of course, as previously indicated, the invention is capable of various applications, it will now be described, since it is in this case that it seems that it must have the greatest interest, within the scope of that of its applications relating to the treatment of a hair which has already been subjected previously to a permanent wave.

In FIG. 1, there is denoted by the reference numeral 1, a hair having a portion 2, waved by a previously carried out permanent, for example, three or four months previously, and a straight portion 3, situated in the vicinity of its root and corresponding to a growth of hair of the order of 3 to 4 cm in the case contemplated.

To subject the hair to a permanent in accordance with the method of the invention, the procedure starts, if necessary, by winding the hair conventionally on a hair curler 4 in the direction indicated by the arrow 5. This winding is continued until the hair curler 4 is brought to about a predetermined length L of the zone 6 separating the straight portion 3 from the waved portion 2 of the hair.

A protective sheet 7 having a length substantially equal to L is then brought into contact with the hair 1, and then the hair curler is rotated further to wind the hair 1 and the sheet 7 simultaneously.

Finally, a roll is obtained such as that shown in FIG. 2, in which the waved portion 2 of the hair is protected by the sheet 7 wound around it, whilst the straight portion 2, that is to say unpermed, emerges from the sheet 7 and is wound around the latter.

It is then possible to apply the permanent wave product to the straight portion 3. If the sheet 7 is constituted by an impermeable material, it is ensured that the product will not be applied to the waved portion 2 of the hair which has already been permed.

To prevent the permanent wave product from flowing between the two portions of sheet 7 which cover one another, provision is made for the free edge 8 of said sheet (that is to say its lower edge in the position shown in FIG. 1) to be provided with means 9 suitable for arresting the flow of liquid, which means will be explained below.

FIG. 3 (in which the elements identical with those of FIGS. 1 and 2 are denoted by the same reference numerals) shows a protective sheet 7 arranged to fulfill the functions which have just been indicated and to facilitate its positioning on the hair curler.

The sheet 7 posseses a flexible web 10 whose width corresponds closely with the useful length of the hair curler 4, for example of the order of 6 to 7 cm, and whose length is substantially greater than the outer diameter of the hair curler, so that its opposite ends 11 and 12 cover one another in the operational position of FIG. 2. By way of example, this length may advantageously be of the order of 8 cm.

As already indicated, the web 10 is impermeable to liquids and, preferably, it adheres lightly to the bodies to which it is applied: in this way the risk of the permanent wave product being able to infiltrate between its overlapping ends is reduced.

In addition, it is desirable for this web 10 to be fairly flexible: by way of example the web 10 may be constituted of polyvinyl chloride and have a thickness of some tens of microns, typically from 10 to 20 microns.

The protective sheet 7 includes also, as indicated above, an arresting means 9, fixed to the edge 8, bounding its end 12 of the web 10 and designed to prevent any flow of permanent wave product towards the waved portion 2 of the hair to be treated.

This means 9 is advantageously in the form of a strip or a beading 13, extending substantially over the whole width of the web 10 and constituted by a liquid-absorbent material, for example, a hydrophilic material.

In order that the assembly may remain modest in cost and to facilitate the fastening, for example by gluing, with the web 10, the beading 13 is of open pore synthetic foam, such as a polyurethane foam.

In the operational position of FIG. 2, the beading 13 is wedged between the roll and the head, and for this reason is held supported against the wound hair, substantially at the level of the zone 6 separating the straight 3 and waved 2 portions: permanent waving product flowing along the arrow 14 of FIG. 2 is absorbed by the beading 13.

To avoid one surface of the beading moistened by the permanent waving product which has been absorbed, from being in contact with the portion 2 of the hair that it is desired to shield from the action of the product, almost the whole of the beading is covered with a protective film, for example of the same material as the web 10, except a narrow strip provided along its free edge, on its inwardly turned surface (in the position shown in the figure) through which excess of permanent waving product would be absorbed.

The protective film 7 is also provided with a positioning element 15, fixed, for example by gluing, to the edge of the web 10 opposite the edge 8, or constituted by a thickening of the web 10.

The element 15 is in the form of a tongue extending substantially over the whole width of the web 10 and incurved transversely with a radius of curvature approximately equal to the radius of the hair curler.

The element 15 is notably more rigid than the web 10 whilst preserving a certain flexibility and may be constituted of any suitable material, such as cardboard or a semi-flexible synthetic material.

The presence of the element 15 facilitates the introduction of the protective film 7 beneath the hair curler 4 as shown in FIG. 1.

It will however be noted that the protective film, provided with the beading, which has just been described is convenient more particularly in the case of a permanent carried out on hair which have already been permed and having a relatively long straight portion.

On the other hand, in the case where it is desired to carry out a permanent in the immediate vicinity of the root (for example in the case of short hair or to obtain a swelling of the normally straight hair), the straight portion to be treated of the hair then being short in length, the beading runs the risk of being poorly applied against the hair and of not playing, or at least of playing poorly its role.

In this case, it is advantageous for the protective film not to include the web 10 and the positioning element 15. Due to the fact that the web 10 is constituted of a material having low adherent characteristics, once it has been wound, its free end will be flattened on the hair curler and the sub-adjacent hair, preventing through this fact the permanent product from seeping into the portion of the hair to be protected.

To avoid the free end of the web from folding on itself, it is possible to envisage arranging it at this place in the same way as at its opposite end, that is to say with an incurved tongue similar to the tongue 15.

FIG. 4 shows a packaging 16 for the application of the method according to the invention.

This package 16 contains, on the one hand, a bottle or flask 17 filled with the permanent waving product and on the other hand, a batch 18 of protective films 7 such as described above. If necessary, this package also includes a batch of hair curlers 19.

As is self-evident, and as emerges already from the foregoing, the invention is in no way limited to those of its types of application and embodiments which have been more especially envisaged; it encompasses, on the contrary, all modifications.

I claim:

1. A protective device for perming a hair with a permanent product only adjacent to the root of said hair and shielding from the permanent product effect the portion of the hair which is not adjacent to said root, comprising the combination of:

a watertight, flexible material sheet, a curved, rigidified part fixed to and extending along one edge of said sheet, and arresting means fixed to and extending along the edge of the sheet opposite to the said one edge, said arresting means being adapted to prevent permanent product from running along the hair under the sheet due to capillary effect.

2. A protective device according to claim 1, wherein the arresting means comprises a strip or beading of absorbent material.

3. A protective device according to claim 2, wherein the absorbent material of the strip or beading is a synthetic foam.

4. A protective device according to claim 3, wherein the synthetic foam is polyurethane foam.

5. A protective device according to claim 1, wherein the flexible material of the sheet has adhesive properties.

6. A protective device according to claim 5, wherein the flexible material having adhesive properties is polyvinyl chloride.

7. A protective device according to claim 1, wherein the curved, rigidified part is of semi-flexible synthetic material.

8. A protective device according to claim 1, wherein the curved, rigidified part is of cardboard.

9. A protective device for perming a hair with a permanent product only adjacent to the root of said hair and shielding from the permanent product effect the portion of the hair which is not adjacent to said root, comprising the combination of:

a watertight, flexible material sheet, two curved, rigidified parts fixed to and extending along two opposite edges of said sheet, and arresting means fixed to and extending along the free edge of one of said parts, said arresting means being adapted to prevent the permanent product from running along the hair under the sheet due to capillary effect.

10. A protective device according to claim 8, wherein the arresting means comprises a strip or beading of absorbent material.

11. A protective device according to claim 10, wherein the absorbent material of the strip of beading is a synthetic foam.

12. A protective device according to claim 11, wherein the synthetic foam is polyurethane foam.

13. A protective device according to claim 9, wherein the flexible material of the sheet has adhesive properties.

14. A protective device according to claim 13, wherein the flexible material having adhesive properties is polyvinyl chloride.

15. A protective device according to claim 9, wherein the curved, rigidified parts are of semi-flexible synthetic material.

16. A protective device according to claim 9, wherein the curved, rigidified parts are of cardboard.

17. A method for carrying out a permanent wave on a hair only in the vicinity of the root of the latter by subjecting the hair to the action of a permanent wave product which comprises arranging a protective sheet along the out-stretched hair in line with the portion of the latter to be shielded from the action of the permanent wave product, winding the hair from the tip thereof with a hair curler while said sheet is situated on the same side of the hair as said curler so that on completion of said winding only the portion of the hair to be treated remains accessible to the action of said permanent wave product and treating said accessible hair with said permanent wave product, said protective sheet comprising the combination of:

a watertight, flexible material sheet, a curved, rigidified part fixed to and extending along one edge of said sheet, and arresting means fixed to and extending along the edge of the sheet opposite to the said edge, said arresting means being adapted to prevent permanent product from running along the hair under the sheet due to capillary effect.

* * * * *